United States Patent [19]

Jürgens

[11] Patent Number: 4,641,289

[45] Date of Patent: Feb. 3, 1987

[54] PROCESS AND DEVICE FOR TRANSMITTING INFORMATION OVER A DISTANCE

[75] Inventor: Rainer Jürgens, Altencelle, Fed. Rep. of Germany

[73] Assignee: Norton Christensen, Inc., Salt Lake City, Utah

[21] Appl. No.: 280,614

[22] Filed: Jul. 6, 1981

[30] Foreign Application Priority Data

Jul. 30, 1980 [DE] Fed. Rep. of Germany ..... 3028813

[51] Int. Cl.[4] ..... G01V 1/40

[52] U.S. Cl. ..... 367/85; 367/83

[58] Field of Search ..... 367/81–83, 367/84–85; 340/861; 175/40, 50, 41, 48

[56] References Cited

U.S. PATENT DOCUMENTS

| | | | |
|---|---|---|---|
| 2,759,143 | 8/1956 | Arps | 367/83 |
| 3,958,217 | 5/1976 | Spinnler | 367/83 |
| 3,983,948 | 10/1976 | Jeter | 367/83 X |
| 4,027,282 | 5/1977 | Jeter | 367/85 |
| 4,078,620 | 3/1978 | Westlake et al. | 367/83 X |
| 4,351,037 | 9/1982 | Scherbatskoy | 367/85 |

OTHER PUBLICATIONS

Patton et al., "Development and Successful Testing of a Continuous-Wave, Logging-While-Drilling Telemetry System", Journal of Petroleum Technology, Oct. 1977, pp. 1215–1221.

*Primary Examiner*—Thomas H. Tarcza
*Assistant Examiner*—Daniel T. Pihulic
*Attorney, Agent, or Firm*—Rufus M. Franklin

[57] ABSTRACT

A downhole telemetry system for transmitting signals from a subterranean region in a well to the surface of the earth while drilling employs changes in the mud pressure encoded in digital form. The changes in mud pressure are accomplished by two balanced valves, one of which increases pressure by control of flow within the drill string, the other of which controls flow from the drill string to the annular between the drill string and the well.

1 Claim, 4 Drawing Figures

PROCESS AND DEVICE FOR TRANSMITTING INFORMATION OVER A DISTANCE

The invention relates to a procedure for distant transmission of information from a bore hole to the surface of the earth. In deep well boring it is of considerable importance to receive information from the bore hole, continuously or at intervals of time, which clarifies the progress of work in the bore hole and which permit taking punctual measures designed to optimize the boring process and to counteract defects or anomalies which may occur.

Many experiments have been undertaken and propositions have been made in the past to ascertain informational data in the bore hole more or less close to the bore hole bottom and to transmit this to the surface of the earth. Because of the, at times, considerable distances, the multiple disturbing influences and the form and the operating conditions of the boring device, this transmission causes significant difficulties. This applies, as well, to transmission principles which use the flushing liquid as a transmitting medium.

BACKGROUND

In a known procedure which makes use of the mud pressure pulsing principle, changes in pressure are made by means of a temporally limited, alternating increase in the pressure of the flushing liquid from a predetermined initial pressure to a predetermined maximum pressure and subsequent reduction of the flushing liquid pressure back to the initial pressure. Thereby the normal working pressure of the flushing liquid is the original starting pressure in the transmission region. Such a series of "positive" pressure pulses are achieved in practice with the aid of a valve in the transmission region of the drill string which reduces and subsequently increases the flow cross-section in the drill string by means of closing and opening its valve body. The pressure difference between maximum and starting pressures, i.e., the amplitude of a pressure-time curve of the pressure pulse series, which can be achieved by this means is very limited and is low in comparison to the value of the starting pressure. Furthermore, the damping effect of the drill string surrounding the transmission medium on the amplitude of the pressure-time curve increases with increasing speed of such pressure change, i.e., with increasing frequency of the pressure-time curve of the pulse series. Hence, pressure pulses of this kind, after passage of the transmitting medium through instrument transformers on the earth surface which measure the pressure in the flushing medium and are designed to reconvert the received pressure pulse series into evaluable informational data, are clearly recognizable only with difficulty, because they are superimposed and distorted by pressure variations in the flushing liquid, which result from numerous influencing factors of the boring procedure itself. An increase in the amplitude of the pressure to desirably large magnitudes is not possible due to the detrimental effect on the boring operation and due to the strong increase in wear phenomena.

In another known process of the kind described, the pressure variation is brought about by a temporally limited, alternating reduction of the pressure of the flushing liquid from an initial pressure to a minimum pressure and increase of the pressure of the flushing liquid from the minimum pressure to the initial pressure. Herewith, also, the normal working pressure of the flushing liquid in the transmission region of the drill string serves as the original pressure and a direct flow connection is established between the drill string and the annular volume of the bore hole which surrounds it to decrease the original pressure to the predetermined minimum pressure. By means of this type of valve regulated circuit, pressure differences between the original pressure and the minimum pressure may be achieved which correspond to the pressure drop of the flushing liquid on its path from the transmission region of the drill string to the rotary drill tool and upward into the annular space. The same difficulties basically hold true in the ability to distinguish "negative" pressure pulse series as mentioned in the beginning in connection with the transmission of "positive" pressure pulse series. An increase in the amplitude of "negative" pressure pulses to desirably large magnitudes does not, to be sure, lead to a strong increase in wear phenomena to the extent as is the case in the generation of "positive" pressure pulses; in respect to its maximum value, it is, however, limited to an amount less than the value of the pressure drop across the rotary drill tool.

The use of either "positive" or "negative" pressure pulses for distance transmission limits the transfer of information due to low transmission speed and limited capability for encoding which is particularly disadvantageous in the transmission of multiple pieces of inform- tion.

To counter this, a further known process of production of "positive" and "negative" pressure pulses of the type described in the overall concept of claim 1 (U.S. Pat. No. 4,027,282) is employed. In this method, the original pressure starts out as an increased pressure compared to the normal working pressure of the flushing liquid in the transmission region of the drill string, which is then raised to a predetermined maximum pressure or lowered to a predetermined minimum pressure, where the predetermined minimum pressure corresponds to the normal working pressure of the flushing liquid in the transmission region of the drill string. This process widens the possibilities for encoding, to be sure, and increases the transmission velocity, however, the recognizability of the pressure pulses received at the surface of the earth is reduced thereby compared to processes using pure "positive" or "negative" pressure pulses, because the total pressure difference between the maximum pressure and the minimum pressure does not exceed the value which, because of the above-named reasons, are achievable in the production of "positive" pressure pulses only. It must also be considered that an apparatus suited to perform this process is expensive to build, complicated and susceptible to trouble, and that a valve which is closed for a long period of time to achieve the increased original pressure is quickly destroyed or damaged by erosion. This applies, as well, to a partially closed valve to achieve this purpose (U.S. Pat. No. 2,759,143). The task underlying the invention is to create a process of the kind described by which pressure pulses with significantly higher pressure differences at an increased transmission speed can be produced, wherewith pressure pulse series with a large extent of configurational variation are capable of being prepared. At the same time, interference with (injury to) the boring operation and the boring apparatus itself is significantly reduced.

SUMMARY OF THE INVENTION

In the process, according to the invention, pressure pulses can be achieved with a total pressure difference region which is significantly greater and which is composed of the partial pressure difference of "positive" and "negative" pressure changes, wherewith the partial pressure difference of "negative" pressure pulses makes use of that domain which results from the pressure drop in the flushing liquid through the rotary drill tool. Due to combined utilization of "positive" and "negative" partial pressure differences in relation to the normal working pressure of the flushing liquid in the transmission region of the drill string interference with (injury to) the boring operation due to modulation of the flushing liquid pressure is significantly less, while, at the same time, producing reduction of the service requirement of the boring apparatus and components of the transmission mechanism. A large degree of variability of the combination of pressure pulses is possible: (1) positive pulses, (2) negative pulses, (3) combined positive and negative pulses, (4) a steep pressure drop by timing of the valve actuation to produce a drop from maximum to minimum pressure with no intermediate pressure interval between, or to produce a similar rise (see numerals 54 and 55 in FIG. 2*b*). The invention further relates to a mechanism for distance transmission of information from a bore hole to the surface of the earth in a development employing two control valves.

In this respect, the assignment which is basic to the invention is the creation of a mechanism which is particularly simple to build, difficult to wear out, and which has a long tool life and operates reliably.

Two valves are sufficient for the mechanism according to the invention, the first valve which produces the increased pressure above the normal working pressure of the flushing liquid is only closed at times during the production of such increases and then only for a short time, so that it is subject to only limited erosion effect. In the time intervals between transmission phases, the boring device may be operated under normal conditions with no throttling of the flushing liquid flow which develops negative effects. With only two drives for the valve bodies of the two valves, the mechanism brings forth a variability of function as was cited in connection with the procedure treated above.

BRIEF DESCRIPTION OF THE DRAWINGS

Procedures and arrangements, according to the invention, are hereafter described in a more detailed manner by means of an execution example for the arrangement in connection with the diagram. in the diagram are shown.

SPECIFIC EMBODIMENT OF THE INVENTION

Figure 4:
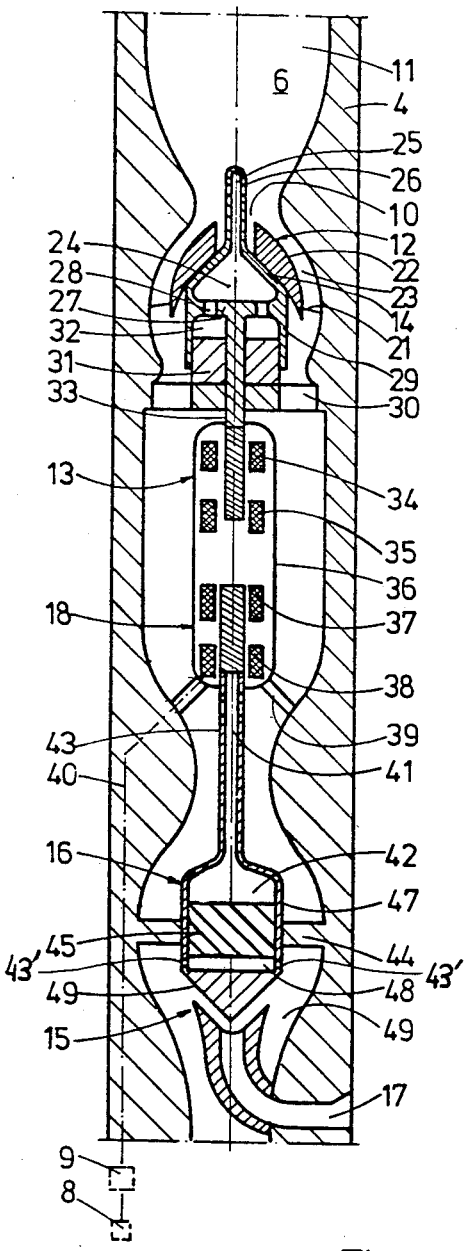
Figure 3:
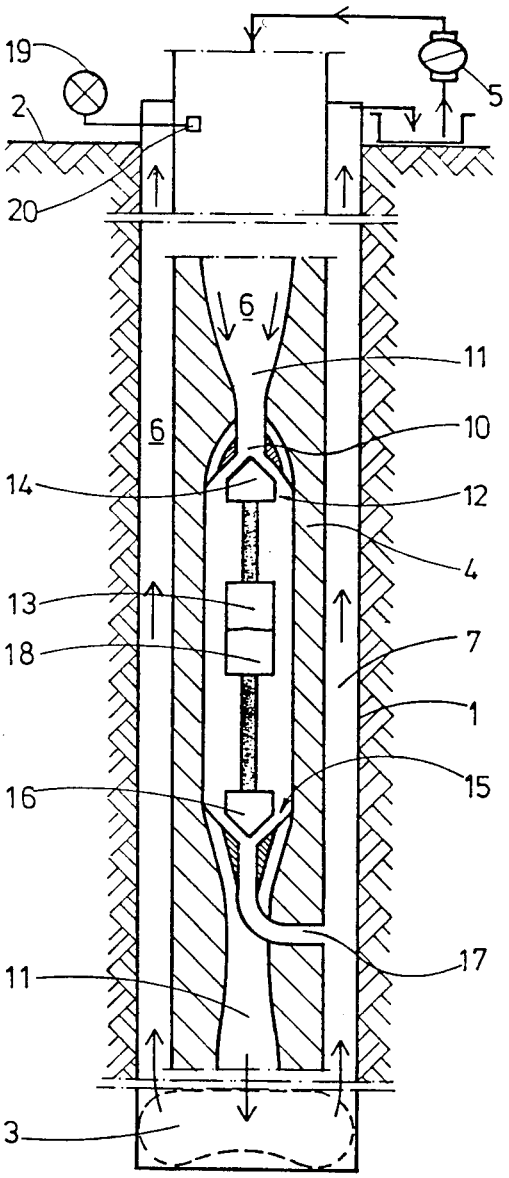

The mechanism according to the invention for distance transmission of information from a bore hole 1 to the surface of the earth 2 during operation of a commonly known boring device, which includes a rotary drilling tool 3, a drill string 4 and a pump 5 which forces a flushing liquid 6 in the drill string downward through the rotary drilling tool 3 and upward in the annular space 7 of the bore hole 1 which surrounds the drill string 4, consists, at a minimum, of a measuring apparatus 8 for the determination of the desired informational data which is attached in a suitable way to the drill string 4, i.e., by a drill collar above the rotary drill tool 3, an analog to digital converter 9 to convert the informational data into a coded series of digital electrical signals (which, by way of example, is energized as is the measuring apparatus 8 by an unillustrated current source, e.g., a battery or a generator), a first valve 12 arranged high in the transmitter region of the drill string 4, which is described in more detail in FIG. 3 and 4, and located in the downward directed flow of the flushing liquid 6, which controls a partial cross-section 10 of the flow channel 11 for the flushing liquid, a controllable drive 13 for opening and closing motions of the valve body 14 of the first valve, which moves as a function of the digital signals of the transformer 9; a second valve 15 which controls a direct connecting duct 17 between the flow channel 11 of the drill string 4 and the annular space 7 of the bore hole 1 with its valve body 16; a separate drive 18 for the valve body 16 of the second valve 15, which, in its turn, is independently controllable as a function of digital signals of the transformer 9; as well as an instrument transformer 19 arranged on the surface of the ground 2 with sensing element 20 for measuring the pressure in the flushing fluid 6 and for reconverting the received pressure pulse series into evaluable informational data.

As FIG. 4 more clearly shows for the represented design example, the first valve 12 coacts with a valve seat piece 22, arranged coaxially in the flow channel 11 of the transmission region of the drill string 4 and supported in this by means of braces 21, which, together with the inner wall of the drill string 4, defines a flow deflection channel 23 for the downward flowing flushing liquid. The valve body 14, shown in FIG. 4 in its closed position, in FIG. 3 in its open position, is formed as a hollow chamber piston and has an upper interior space 24 with a continuation 25 which extends through the valve opening surrounding the current flow cross-section 10 toward the top. The continuation 25 is provided with a connecting opening 26. The upper interior space 24 is bounded on the lower side by a wall 27 which serves to support the valve body on the stem 33. Connecting openings 28 are located to equalize pressure on both sides of wall 27. In the region below the wall 27, the valve body 14 has a circular apron 29, which, under a sealed condition, grips around a piston-like sealing body 31 which is supported by braces 30 stationary in the drill string 4. The wall 27, the circular apron 29 and the sealing body encircle a lower interior space 32, in which flushing liquid is found at an increased pressure, as is present in the flushing liquid at the position of the connecting opening 26 of the continuation 25. By means of suitable regulation of the cross-section of the piston pressure surface which is effective for the valve body 14 in relation to the outside surface of the valve body 14 which is struck by the flushing liquid, the valve body 14 may be balanced to such a degree that the hydraulic pressures acting on the valve body 14 are at least substantially compensated.

A piston rod 33 is engaged coaxially on the under side of the wall 27. The piston rod 33 extends through the sealing body 31, being sealed, and may be set in motion by an electromagnet as a drive 13 whose windings are designated as 34 and 35. This drive 13 is located in a central housing 36 which the flushing liquid 6 may stream around and in which the separate drive 18 of the second valve 15 is also located. This drive 18 is formed as an electromagnet as well whose windings are designated as 37, 38. The housing 36 is supported by the schematically depicted braces 39 stationary opposite the drill string 4, through which electrical connection circuits from the devices 8, 9 may be led in. A battery or a generator arranged anywhere may, as an example, be provided as a current source. It is to be understood, however, that, instead of electro-magnetic drives, any otherwise suitable drives may be used.

The valve body 16 of the second valve 15 is also formed as a hollow chamber piston because of its hydraulic pressure compensation. Its piston rod, actuated by drive 18, is formed in the shape of a pipe in a region below the housing 36 and encloses an upward extending continuation of an upper interior space 42 in the valve body 16 which is connected by means of connecting openings 43 with the flushing liquid in the flow channel 11 in the transmission region of the drill string 4. The upper inner space 42 in the valve body 16 is bordered on its lower side by a cylindrical guide body 45, which is fixed in a stationary manner in the drill string 4 by means of braces 44 which, like braces 30, support the element 45 spider fashion while allowing flow past it. Openings 43' in apron 47 connect the lower side of body 45 with fluid pressure in the drill string. The valve body 16 grasps around the sealing body 45 under seal with an apron 47 and is axially displaceable along it. Apron 47 has clearance slots for relative axial movement between the apron and sealing body 45 with its braces 44. A lower inner space 48 is located under the seal body 45 and below this is located the valve cone 49 of the valve body 16. This lower inner space 48 is at the increased pressure of the flushing liquid as it exists in this at the position of the connecting openings 43', and here, as well, the effective piston pressure surface of the valve body 16 may be balanced in relation to its surface which is struck by pressure, so that the valve body 16 at least is essentially pressure compensated. The valve body 16 and the valve seat piece 49, formed at the inner end of the connecting conductor 17, operate together. This valve seat piece 49, like the corresponding piece 22 of the first valve 12, is arranged coaxial in the flow channel 11 and is passable by the flushing liquid 6.

In normal operation of the drilling device, the first valve 12 is in the open position and the second valve 15 in the closed position. Therefore, the flushing liquid which is pumped downward by the pump 5 in the drill string 4 has a normal working pressure in the transmission region of the bore pipe bed 5 as regulated by the performance of the pump 5 taking into consideration all of the flow losses, etc. in the transmission region. If the informational data determined by the measuring device 8 and digitally coded by the converter 9 are now to be transmitted to the earth surface, the drives 13 and 18 are released for control by the coded series of digital electrical signals of the transformer 9 by means of a suitable switch, operable in any known or suitable way, to produce pressure pulses in the flushing liquid corresponding to the digital electrical signals by the operation of the valve bodies 14 or 16 of the valves 12 and/or 15. According to the control of the drives 13 and/or 18, "positive" pressure pulses 50 corresponding to FIG. 2*a* may, for instance, be produced by successive closing and opening motions of the valve body 14 alone. Furthermore, "negative" pressure pulses 51 represented in FIG. 2*a* may be produced by opening and closing motions of the valve body 16 alone.

Figure 1:
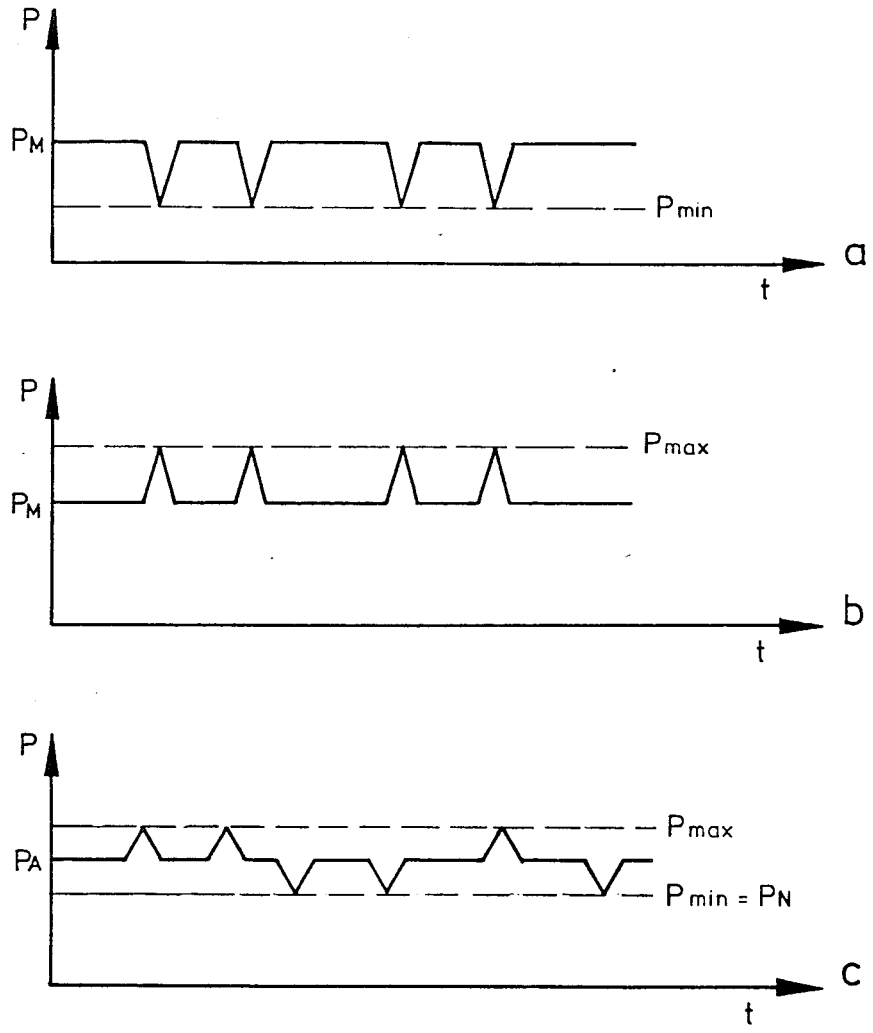
FIG. 1 Pressure-time curves for visualization of pressure pulse series of known procedures with, in (a) completely "negative" pressure pulses, (b) completely "positive" pressure pulses and (c) alternating "positive" and "negative" pressure pulses, FIG. 2 Pressure-time curves conforming to the procedure according to the invention with, in (a) "positive" and "negative" pressure pulses similar to FIG. 1*c* however with enhanced pressure differences, with, in (b) in the first instance alternating "positive" and "negative" pressure pulses and connecting combined "positive/negative" pressure pulses of a first configuration, and with, in (c) in the first instance combined "positive/negative" pressure pulses of directly connected configuration, then combined "positive/negative" pressure pulses in single successive configuration and finally combined "positive/negative" pressure pulses with a step configuration, FIG. 3 A schematic, discontinuous longitudinal section through the transmission region of the drill string of a boring device with a simplified representation of the major parts of the mechanism for distance transmission of information according to the invention, and FIG. 4 a longitudinal section similar to FIG. 3 in an enlarged representation for clearer rendering of detail.
Figure 2:
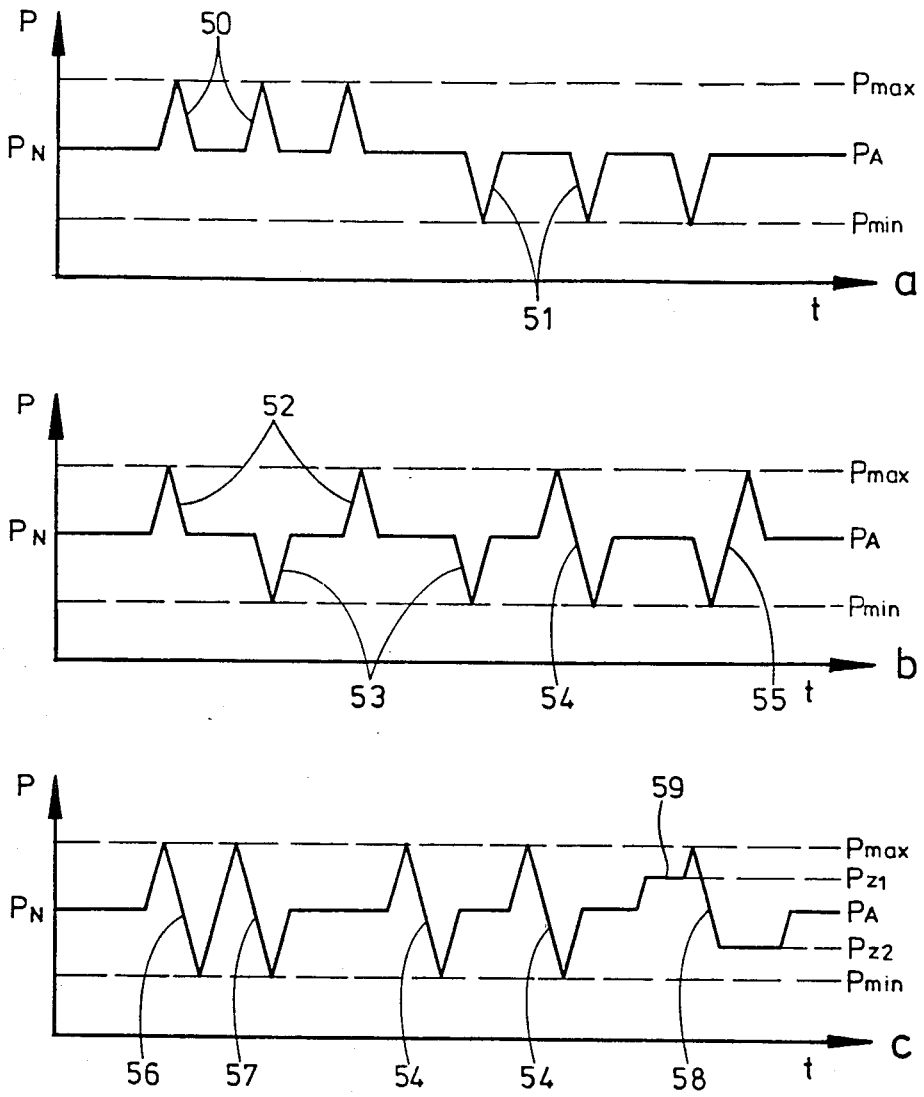

By means of closing and opening motions of the valve body 14 of the first valve 12 alternating with opening and closing motions of the valve body 16 of the second valve 15, successive "positive" and "negative" pressure pulses 52, 53 according to FIG. 2*b* may be produced. By closing and opening the first valve 12 and opening and subsequent closing of the second valve 15 timed to the opening of the first valve a pressure pulse 54 corresponding to FIG. 2*b* may be produced which has a pressure slope which extends over the total pressure differential region. By means of successive opening and closing of the second valve 15 and opening of the first valve 12, timed to the closing of the closing of the second valve 15, with subsequent closing of this valve a pressure pulse 55 is originated with a corresponding pressure slope in the region of rising pressure instead of in the region of decreasing pressure as in the pressure pulse 54.

While the pressure pulses 54, 55 in FIG. 2*b* still succeed each other separately, the pressure pulses 56, 57 in FIG. 2*c* are figured to be directly contiguous to each other, so that both of these pressure pulses display three pressure slopes which extend over the entire pressure differential.

Finally, FIG. 2*c* shows the configuration of a pressure pulse 58 which rises with a pressure graduation as in 59 by way of an intermediate pressure ($P_{zl}$) to a maximum pressure ($P_{max}$) and then decreases to a pressure $P_{z2}$) lying above the minimum pressure ($P_{min}$), with a continuous pressure slope, before again, after a time lapse increasing to the initial pressure ($P_A$) which corresponds to the normal working pressure ($P_N$) of the flushing liquid 6 in the transmission region.

The pressure pulse series which may be produced by the respective activation of the valves 12 and/or 15 may, as shown by the examples in FIG. 2*a* to 2*c*, can be formed in several configurations, to transmit correspondingly multiple informational data to the surface of the earth. This is done in a clearly recognizable manner quickly and, despite its speed, with a high "signal to noise ratio." The normal working pressure in the flushing liquid 6 is always immediately re-established in the transmission region during all pauses in transmission.

By means of appropriately suitable formation of the drives 13, 18, these cannot only move the respective valve bodies 14, 16 baetween the fully closed or fully opened positions, but can also produce motions of the valve bodies 14, 16, in which these may remain for a predetermined time span in an intermediate position between fully open and fully closed.

What is claimed is:

1. Device for transmitting information over a distance from a bore hole to the surface of the earth during operation of a boring implement which encompasses a rotary drill tool, a drill string and a pump to convey downward flowing flushing liquid, in which the normal working pressure, as increased in pressure by the pump, which exists in a subterranean transmission region of the drill string is altered to form a series of pressure pulses, which is equivalent to a pulse code of digital signals containing the information to be transmitted over a distance and which is sensed at a subterranean region and evaluated at the surface of the earth, in which the pressure change is undertaken by means of a temporally limited, alternating increase in the pressure of the flushing liquid from a predetermined normal operating initial pressure up to a predetermined maximum pressure and reduction of the pressure of the flushing liquid to a pressure value between the maximum pressure and a predetermined minimum pressure which falls below the initial pressure, characterized by the fact that, the initial pressure starts out as the normal working pressure of the flushing liquid in the transmission region of the drill string, the flow channel available to the flushing liquid in the drill string is reduced by a first valve to achieve a pressure increase and by the fact that a direct flow connection between the drill string and the annular space which surrounds it in the bore hole is established by a second valve to achieve pressure reduction below the original pressure, in a predetermined sequential manner, said first valve controlling the amount of flushing liquid flowing through a parallel bypass path within the drill string, both valves being provided with pressure balancing surfaces, both valves supported coaxially in the central region of the flow channel of the drill string and being positionable in intermediate position between fully open and fully closed.

* * * * *